US005825839A

United States Patent [19]

Baskis

[11] Patent Number: 5,825,839

[45] Date of Patent: Oct. 20, 1998

[54] METHOD AND APPARATUS FOR CONVERTING RADIOACTIVE MATERIALS TO ELECTRICAL ENERGY

[76] Inventor: Paul T. Baskis, 723 Galaxy St., Rantoul, Ill. 61866

[21] Appl. No.: 610,891

[22] Filed: Mar. 5, 1996

[51] Int. Cl.[6] ..... G21H 1/00

[52] U.S. Cl. ..... 376/320; 310/305; 136/202

[58] Field of Search ..... 376/320, 321, 376/322; 136/202; 310/305, 301; 429/5

[56] References Cited

U.S. PATENT DOCUMENTS

| | | | |
|---|---|---|---|
| 2,527,945 | 10/1950 | Linder . | |
| 2,598,925 | 6/1952 | Linder . | |
| 2,651,730 | 9/1953 | Linder . | |
| 3,019,358 | 1/1962 | Ohmart . | |
| 3,167,482 | 1/1965 | Katz . | |
| 3,483,040 | 12/1969 | Parkins . | |
| 3,497,392 | 2/1970 | Walker . | |
| 3,706,893 | 12/1972 | Olsen et al. . | |
| 3,939,366 | 2/1976 | Ato et al. . | |
| 4,415,526 | 11/1983 | Garrett . | |
| 4,462,954 | 7/1984 | Weinert . | |
| 4,663,115 | 5/1987 | Russell | 376/320 |
| 4,835,433 | 5/1989 | Brown . | |
| 5,111,099 | 5/1992 | Smith | 136/202 |

FOREIGN PATENT DOCUMENTS

| | | |
|---|---|---|
| 260879 | 8/1963 | Australia . |
| 900056 | 7/1962 | United Kingdom . |

OTHER PUBLICATIONS

Technical Paper—"Nuclear Properties" by Rafael Kalish—High–Energy Spin Physics, Proceedings of the International Conference (K.J. Heller, ed.). AIP Conf. Proc. No. 187, vol. 2. American Institute of Physics, New York, 1989. pp. 838–842.

*Primary Examiner*—Daniel D. Wasil

[57] ABSTRACT

A method and apparatus for converting radioactive energy into electrical energy is provided and includes a first radioisotope (24) emitting alpha particles and a second radioisotope (28) emitting beta particles. A first plate (16) is positioned proximate the first radioisotope (24) and is adapted for capturing the alpha particles wherein the first plate (16) is positively charged. A second plate (18) is positioned proximate the second radioisotope (28) and is insulated from the first plate (16). The second plate (18) is adapted for capturing the beta particles wherein the second plate (18) is negatively charged for establishing an electrical potential between the first plate (16) and the second plate (18). A housing accommodates the radioisotopes (24,28) and plates (16,18) and has a first contact (40) connected to the first plate (16) and a second contact (42) connected to the second plate (18). An electrical potential is generated between the two contacts (40,42). An electrical load L is connected between the first and second contacts (40,42) for permitting the beta particles to travel from the second plate (18), through the second contact (42), the load L and the first contact (40) and to the first plate (16). The alpha particles in the first plate (16) capture the beta particles transmitted thereto to produce helium.

12 Claims, 5 Drawing Sheets

METHOD AND APPARATUS FOR CONVERTING RADIOACTIVE MATERIALS TO ELECTRICAL ENERGY

DESCRIPTION

Technical Field

The present invention relates generally to a method and apparatus for converting radioactive decay energy to electrical energy, and more particularly, to a battery which utilizes radioactive material as a donor of charged particles to establish an electrical potential. The chemical reactive properties of the particles are specifically used to produce the electricity.

BACKGROUND OF THE INVENTION

As the modernization and industrialization of society increases, it is expected the demand for electrical power will increase. Currently, the steam turbine generator provides the majority of the electrical power. Steam for the turbine is produced by burning fossil fuels or subjecting nuclear fuels to a conventional process known as fission.

There are some well known limitations to burning fossil fuels. First, the supply of fossil fuels, such as coal and oil, is limited. Second, there are some significant environmental concerns.

In past years, the use of nuclear fuels was aggressively pursued as an alternative to fossil fuels. As a result, there are numerous nuclear plants producing power. As the useful life of nuclear plants is normally over 30 years, nuclear power is expected to continue as an important source of electrical power.

When nuclear fuel undergoes fission, atoms are disintegrated into smaller particles which releases large amounts of energy. This process is generally referred to as fission. One of the primary drawbacks to using nuclear fuel is the radioactive waste which results from this fission process. Much of the resulting waste is in the form of "spent" fuel rods which cannot efficiently sustain the fission process in the reactor. Therefore, after serving their useful lives, the spent fuel rods are removed from the reactor. The fuel rods, however, still possess a significant amount of their original energy production capability. Even after being removed from the reactor, the fission process continues in the fuel rod and energy continues to be released mainly in the form of kinetic energy which is subsequently converted to heat energy. This is sometimes referred to as radioactive decay. Thus, the fuel rods continue to produce energy through the fission process as the fuel rods undergo radioactive decay. When undergoing radioactive decay, the fuel rods are still "hot" in terms of radioactivity. The rods, therefore, must be isolated until they are no longer radioactive; this can take thousands of years.

Oftentimes, the spent fuel rods are stored in a cooling pool located at each nuclear power plant site. After the fuel rods have undergone a certain amount of radioactive decay, the rods can be moved to another site, such as an underground burial site until the decay process is complete. Unfortunately, there are no final procedures for such storage of spent fuel rods and other radioactive material.

Nothing is being done to use the tremendous amount of radioactive decay energy that exists in radioactive material, especially in the spent fuel rods. Thus, there remains a need for an apparatus and procedure for efficiently utilizing the radioactive decay energy of radioactive material, such as spent fuel rods, preferably for additional electrical energy production. Other attempts have been made to convert radioactive decay energy to electrical energy. However, these attempts appear not to have been commercially feasible due to their complexity or minimal power generating capabilities.

When radioactive materials undergo decay, they emit a variety of particles. Two primary particles are emitted. First, radioactive nuclei, predominantly helium nuclei (He2+), but including other rare earth elemental nuclei, are emitted. These particles are positively charged and travel at relatively slow velocity. Second, beta particles, or electrons, are emitted. Beta particles are negatively charged and travel at a relatively high velocity, approximately ¾ the speed of light. Many prior attempts at converting radioactive decay energy to electrical energy use the radioactive decay particles directly to do work in the form of kinetic energy or transferred energy from the particle into a separate mechanism such as a semi-conductor. The present invention does not utilize these concepts. The present invention uses the radioactive decay process only as a donor of charged particles to establish an electrical potential. It then utilizes the charged particles in a chemical reaction resulting in the formation of helium and the production of approximately 4 electron volts per molecule of helium formed. Alternatively, the present invention uses chemical protons (cations) donated by the earth to produce the electromotive force (EMF) gradient.

SUMMARY OF THE INVENTION

The present invention solves many of the aforementioned problems and shortcomings, and relates to a method and apparatus for converting radioactive decay energy to electrical energy. According to a first aspect of the invention, a battery has a first radioisotope emitting alpha particles and a second radioisotope emitting beta particles. A first plate is positioned proximate this first radioisotope for capturing the alpha particles resulting in the first plate becoming positively charged. A second plate is also positioned proximate the second radioisotope and is insulated from the first plate. The second plate is further adapted to capture the beta particles; the second plate thus becomes negatively charged. An electrical potential is thus established between the first plate and the second plate. A housing is further provided to hold and shelter the two radioisotopes and the two plates.

According to another aspect of the invention, the housing of the battery has openings therein to receive a first lead and second lead. The first lead is connected to the first plate and the second lead is connected to the second plate. As a result of this configuration, an electrical potential is generated between the two leads. An electrical load is connected between the first and second leads to allow the beta particles to travel from the second plate, through the second lead, the load and the first lead and to the first plate. The alpha particles in the first plate capture the beta particles transmitted thereto to produce helium.

According to another embodiment of the invention, the battery includes radioactive material emitting alpha particles and beta particles therefrom. A grid defining a first medium is positioned proximate the radioactive material. The alpha particles emitted from the radioactive material are then captured in the first medium positively charging the first medium. A container, encases the radioactive material and the grid. The container is insulated from the radioactive material and the grid and is plated with a conductor on the inside surface of the container to define a second medium. The beta particles pass through the grid and are captured in this second medium negatively charging the second medium. An electrical potential is generated between the first and second mediums.

According to a still further aspect of the invention, the battery includes a first lead and a second lead, each having a first and second end. The first end of the first lead is connected to the first medium and the first end of the second lead being connected to the second medium. The electrical potential is consequently present between the second ends of the two leads. An electrical load connected between the first and second leads permits the beta particles captured by the container to travel from the second medium, through the second lead, the load and the first lead and to the first medium. The alpha particles in the first medium capture beta particles transmitted thereto to produce helium.

According to another embodiment of the invention, the first lead of the battery is connected from the load to an earth ground. In this configuration, an electrical potential is present between the second medium and the earth ground.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE PREFERRED EMBODIMENT

Figure 1:
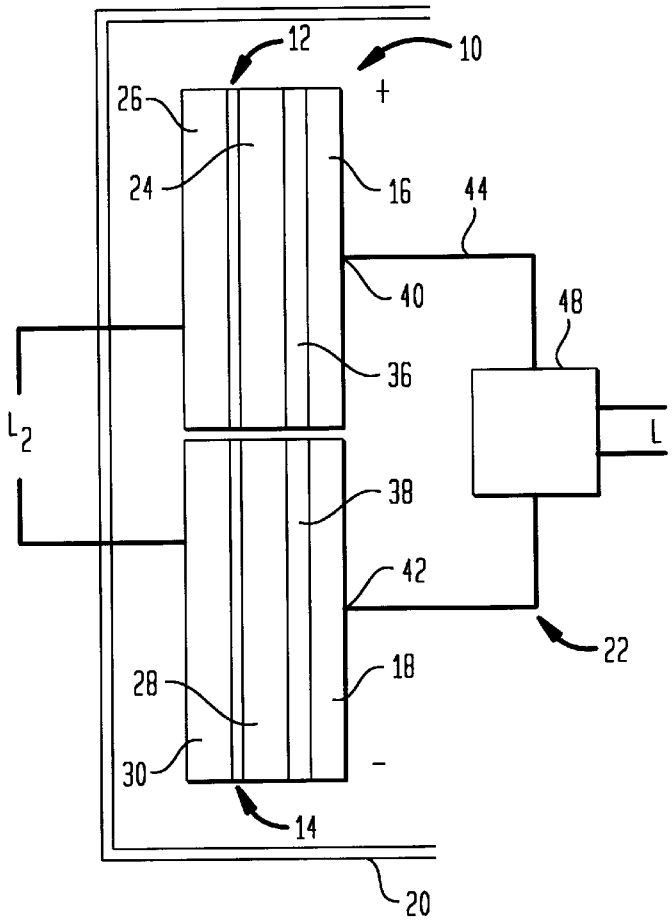
FIG. 1 is a schematic view of a first embodiment of a battery made in accordance with the teachings of the present invention.

While this invention is susceptible of embodiment in many different forms, there is shown in the drawings and will herein be described in detail, some preferred embodiments of the invention with the understanding that the present disclosure is to be considered as an exemplification of the principles of the invention and is not intended to limit the broad aspect of the invention to the embodiments illustrated.

A first embodiment of a battery of the present invention will first be described referring to FIGS. 1–4. Second and third embodiments of a battery of the present invention will then be described referring to FIGS. 5–7.

First Embodiment

FIG. 1 shows a first embodiment of a nuclear battery of the present invention, generally designated by the reference numeral 10. The nuclear battery 10 generally includes radioactive material assemblies 12,14, particle capture plates 16,18, a housing 20 and electrical conductors 22.

Figure 2:
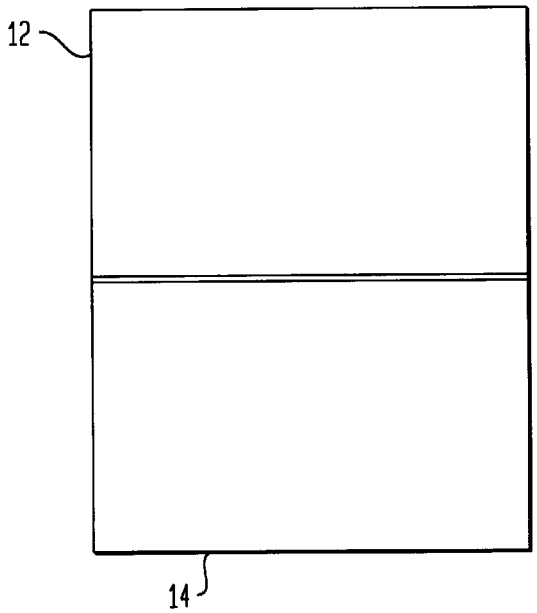
FIG. 2 is a front elevational schematic view of radioactive material assemblies of FIG. 1.

As shown in FIG. 1, the battery 10 has a first radioactive material assembly 12 adjacent to a second radioactive material assembly 14. The first radioactive material assembly 12 includes a first radioisotope 24 and a stainless steel member 26. The first radioisotope 24 is attached to the stainless steel member 26 using a conventional cladding process. The cladding process is a typical electroplating process well known, for example, in the electronics industry. Likewise, the second radioactive assembly 14 includes a second radioisotope 28 cladded to a stainless steel member 30. As shown in FIGS. 1 and 2, the assembly 12 is generally rectangular and relatively thin. The assembly 14 generally has a similar shape as the assembly 12. It is, of course, recognized these components may take other shapes and sizes.

The first radioisotope 24 emits alpha particles and can be one of numerous different materials. These materials include, but are not limited to: Americium-241, Caesium-137, Carbon-14, Chlorine-36, Hydrogen-3 (Tritium), Krypton-85, Lead-210, Neptunium-237, Nickel-63, Plutonium-238, Uranium-238 and Uranium-244. The second radioisotope 26 emits beta particles and, likewise, can be one of numerous different materials. These materials include, but are not limited to: Americium-241, Antimony-124, Antimony-125, Barium-140, Bromine-82, Caesium-134, Caesium-137, Calcium-45, Calcium-47, Carbon-14, Cerium-141, Cerium-144, Chlorine-36, Cobalt-56, Cobalt-58, Cobalt-60, Europium-152, Gold-198, Gold-199, Hydrogen-3, Iodine-129, Iodine-131, Iridium-192, Iron-59, Krypton-85, Lanthanum-140, Lead-210, Mercury-203, Molybdenum-99, Neptunium-237, Nickel-63, Niobium-95, Phosphorus-32, Plutonium-238, Potassium-42, Promethium-147, Ruthenium-106, Scandium-46, Silver-110m, Sodium-22, Sodium-24, Lead-212, Bismuth-212, Thulium-170, Tungsten-185, Uranium-238, Thorium-234, Protactinium-234m, Protactinium-234, Uranium-244, Xenon-133, Yttrium-90, Yttrium-91, Zinc-65 and Zirconium-95. In short, there are many different radioisotopes that can be used in the battery 10. These radioisotopes are generally low energy, low radioactivity and emit particles in the 1,000–1,000,000 kilovolt range. Thus, the particles have low kinetic energy and consequently do not have high penetrating power. The power requirements and intended use of the battery 10 may control which materials will be best suited for the radioisotopes 24,28. Also, the availability of the radioisotopes will also have an impact on the selection.

As further shown in FIG. 1, a first particle capture plate 16 is positioned proximate the first radioisotope 24. Preferably, the surfaces of the first particle capture plate 16 and the first radioisotope 24 are parallel or oppose each other so that the maximum surface areas of both the plate 16 and the radioisotope 24 face or are adjacent each other. In a preferred embodiment, the capture plate 16 is spaced approximately 2–3 millimeters from the radioisotope 24. The first plate 16 captures the alpha particles emitted by the first radioisotope 24. A second particle capture plate 18 is positioned proximate the second radioisotope 28. In a preferred embodiment, the capture plate 18 is also spaced approximately 2–3 millimeters from the radioisotope 28. The second plate 18 captures the beta particles emitted by the second radioisotope 28. The plates 16,18 can be of a number of different configurations and be made from a number of different materials. The plates 16,18 can be solid or of a fine wire grid or screen. The plates 16,18 can also be made from metal such as gold, platinum or copper or from plastics having metallic characteristics or with fine metal particles, such as sintered iron, provided as a filler for the plastic. In any event, the desirable characteristics for the plates 16,18 are electrically conductive, low resistance, and stable, i.e., the alpha particles can easily take beta particles from the plate. Preferably, the capture plates 16,18 are made from metals that are resistant to corrosion such as platinum, gold, stainless steel.

Although not necessary, polysiloxane insulators 36,38 may be positioned between each radioactive assembly 12,14 and the capture plates 16,18. This will allow the use of radioisotopes which have somewhat higher energy levels such as 1,000,000 mega electron volts (MEV). The insulators 36,38 will slow the particles as they approach the capture plates 16,18. Polysiloxane is a synthetic material having a silicon linking mechanism which gives it stability. The insulators 36,38 can be obtained from Ameron® Protective Coatings Systems, 201 North Berry Street, Brea, Calif. 92022. If desired, vacuum or gas insulators, can be used instead of the polysiloxane insulators 36,38.

The housing 20 is provided to encase the radioactive material assemblies 12,14, the plates 16,18 and the insulators 36,38. The housing can be a number of different shapes which may depend on the shape of the load to be operated. For example, the battery housing for a flashlight may be cylindrical or rectangular. The housing 20 is preferably made from Lexan material although other high-density materials can be used. The radioactive material assemblies 12,14 and the plates 16,18 are insulatively mounted (not shown) in the housing 20. Also, the first radioactive material assembly 12 and first plate 16 are insulated from the second radioactive material assembly 14 and the second plate 18. The housing is provided with electrical conductors 22. In one design, the housing is provided with a first contact 40 which is connected to the first plate 16, and a second contact 42 which is connected to the second plate 18. Alternatively, the housing has openings to receive a first lead 44 connected to the first plate 16 and a second lead 46 connected to the second plate 18.

In operation, the first radioisotope 24 emits alpha particles which are captured by the first plate 16. As the alpha particles carry a positive charge, the first plate becomes positively charged. The second radioisotope 28 emits beta particles which are captured by the second plate 18. As the beta particles carry a negative charge, the second plate becomes negatively charged. An electrical potential is established between the first plate 16 and the second plate 18. The electrical potential represents the electromagnetic force (EMF) associated with the battery. As the contacts 40,42, or the leads 44,46, are connected to the first and second plates 16,18, the electrical potential is generated between the contacts 40,42 or leads 44,46 as well. The radioisotopes 24,28 continually emit alpha and beta particles to the plates 16,18. Consequently, the plates 16,18 can become saturated with alpha and beta particles, respectively, if a load is not connected across the plates 16,18. In such case, the like charges will repel the particles back to the respective radioisotopes 24,28.

As further shown in FIG. 1, an electrical load L is then connected between the first lead 46 and second lead 44. This connection permits current flow in the form of the beta particles, now as electrons in an electronic circuit, i.e., the second radioisotope is donating beta particles (electrons) to the conductors 22 to drive the load L. Specifically, this load permits the beta particles to travel from the second plate 18, through the second lead 46, the load L and the first lead 44 and finally to the first plate 16. As the beta particles are transmitted to the first plate 16, a chemical reaction occurs where the alpha particles react with the beta particles to produce helium. Again, the alpha particles are helium nuclei (He2+) and need to capture only two electrons, or beta particles to become chemically stable. Thus, each alpha particle captures a pair of beta particles to form a stable helium atom. The load continues to be driven since the travel of beta particles is essentially current flow passing through the load. The number of beta particles available from the second radioisotope will determine the amount of work the battery can provide.

As the beta particles continue to be transmitted, additional reactions occur producing more helium. This particular embodiment is best suited for portable type batteries. The amount of helium produced in such batteries is small and, furthermore has no detectable radioactivity. The helium is, therefore, allowed to dissipate from the housing to the atmosphere. Larger batteries produce much more helium making it beneficial to conserve the helium for later use as will be described below.

It is also desirable to balance the number of alpha and beta particles available between the radioisotopes 24,28. In an optimal condition, there will be twice as many beta particles as alpha particles because the alpha particles need two beta particles to become chemically stable. When an alpha particle combines with a pair of beta particles, it is termed as an "event." Thus, the number of events, i.e., the production of chemically stable helium atoms, will be maximized if there are twice as many beta particles as alpha particles. If the number of particles was not balanced, helium ions may be emitted from the battery 10.

The current provided by the flow of beta particles through the second lead 46 is direct current (DC). Thus, a DC load can be directly driven by the battery 10. If desired, however, a conventional AC converter circuit 48 can be connected between the first and second leads 44,46 to convert the direct current to alternating current (AC).

Also during operation, as the alpha and beta particles are emitted from the radioisotopes 24,28, an opposite charge may develop in the stainless steel members 26,30. For example, when the second radioisotope 28 emits a beta particle, a positive charge may develop in the stainless steel member 30 which could reduce the number of beta particles being emitted to the second plate 18. These opposite charges are referred to as coulomb forces. A similar but opposite coulomb force could develop in the stainless steel member 26 connected to the radioisotope 24 emitting alpha particles. The coulomb forces are undesirable because they prevent the maximum amount of particles to be emitted from the radioisotopes. To minimize the development of the coulomb forces, a secondary electrical load L2 is connected between the stainless steel members 26,30. The secondary load L2 can be used for additional electrical power.

Figure 3:
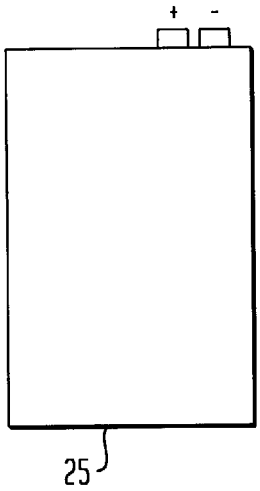
FIG. 3 is front elevational schematic view of an alternative radioactive material assembly for the battery of FIG. 1.
Figure 4:
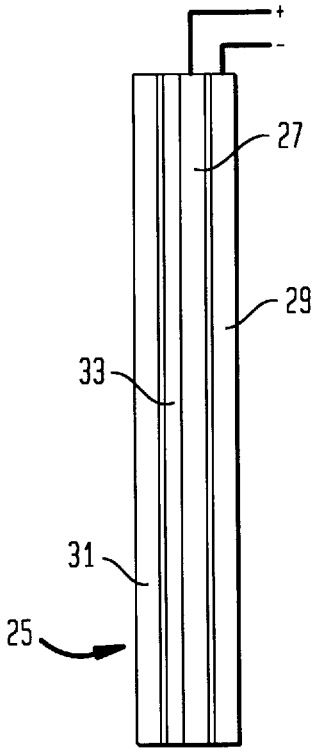
FIG. 4 is a side elevational schematic view of the alternative radioactive material assembly of FIG. 3.

Although two separate radioactive material assemblies 12,14 are used in the first embodiment, a single radioactive assembly could also be used which emits both alpha and beta particles. FIGS. 3 and 4 show an alternative embodiment utilizing such a radioactive assembly. As seen in FIG. 4, the alternative embodiment includes a radioactive material assembly 25, an alpha particle capture plate 27 and a beta particle capture plate 29. The radioactive material assembly includes a single stainless steel plate 31 cladded with an appropriate mix of radioactive material 33. The radioactive material 33 includes isotopes that emit both alpha particles and beta particles. The alpha particle capture plate 27 can be a plastic composite which may have a fine gold screen mesh to lower resistance. The capture plate 27 is preferably 2–3 millimeters thick and confronts the radioactive material assembly 25. The beta particle capture plate 29 confronts the capture plate 27 and is preferably made from corrosion resistant material such as copper, gold or platinum. In this configuration, the alpha particles are captured in the alpha particle capture plate 27 positively charging the capture plate 27. Due to their high kinetic energy, the beta particles pass through the capture plate 27 and are captured in the beta particle capture plate 29 negatively charging the plate 29. Thus, an electrical potential is created between the capture plate 27 and the capture plate 29. As described above, a load can be driven by this electrical potential as the beta particles will travel from the capture plate 29, through the load, and to the capture plate 27.

Furthermore, the structure of the first embodiment can be used for many different size batteries. Preferably, the battery 10 is a portable battery suitable, for example, in cellular telephones.

Second Embodiment

Figure 5:
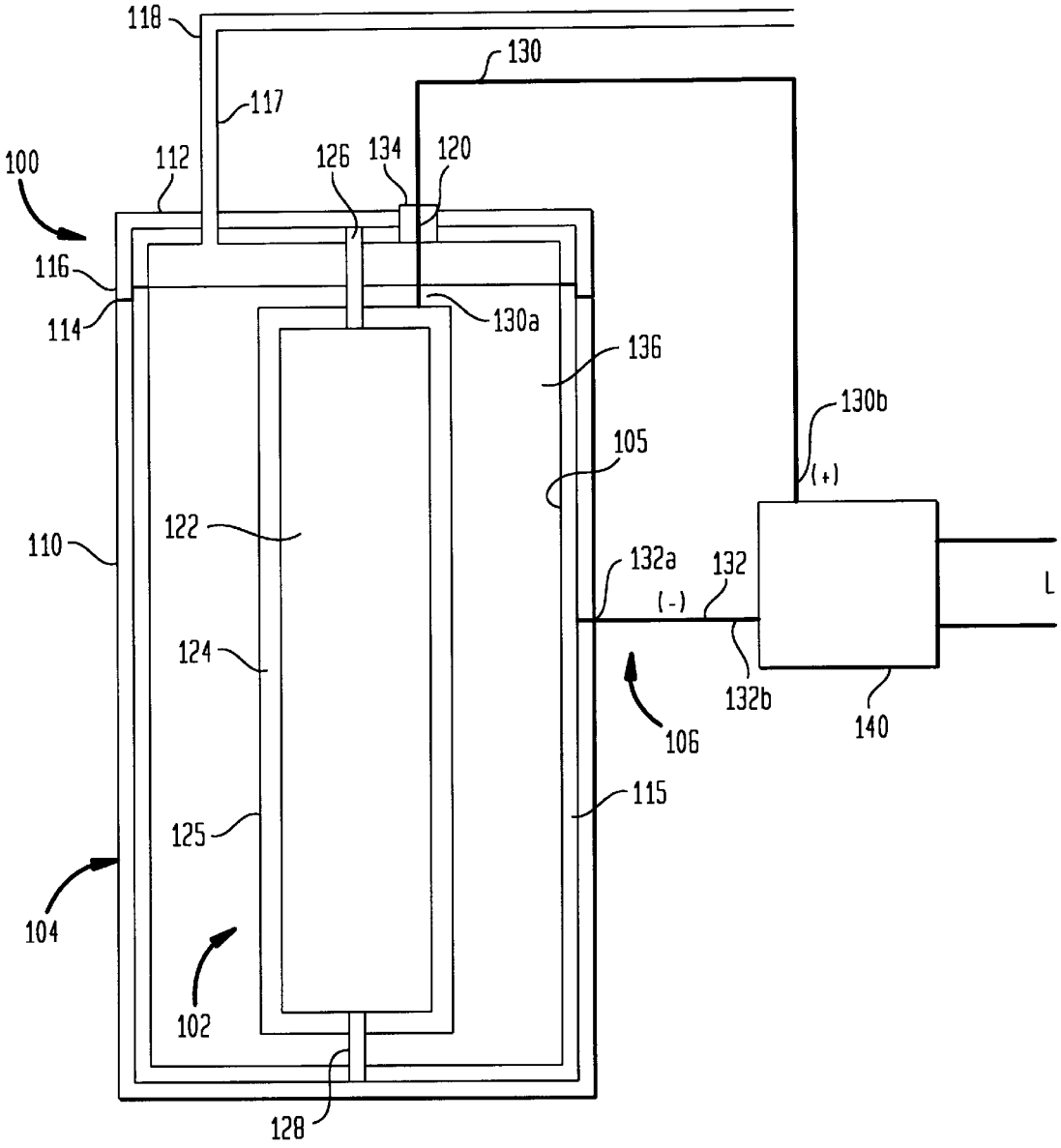
FIG. 5 is a schematic view of a second embodiment of a battery of the present invention.

FIG. 5 shows a second embodiment of a nuclear battery of the present invention, generally designated by the reference number 100. The battery 100 generally includes a radioactive material assembly 102, a container 104 and electrical conductors 106. A gas removal system 108 (FIG. 6) can also be utilized with the battery 100.

The container 104 generally includes a base 110 and a cap 112. The base 110 is an open-ended cylinder although other forms may also be used. The base 110 has a lip portion 114 at its open end. The cap 112 is generally planar and has a lip portion 116 corresponding to the lip portion 114 of the base 110 to provide for a sealed container. The cap 112 has a gas opening 117 to receive a gas removal conduit 118 and a conductor opening 120 to receive an electrical conductor to be described below. The outside of the container 104 can be constructed from Lexan material approximately 5.0 centimeters or more thick. Lexan material is generally a crystalline plastic and very strong. The inside surface of the container 104 can be made of a highly conductive metal that is resistant to corrosion, such as gold, platinum, stainless steel, etc. In a preferred embodiment, the inside surface of the container 104 can be plated with a corrosive resistant plate conductor 105 that defines a second medium 115 to be described in greater detail below.

The radioactive material assembly 102 generally includes a spent fuel rod 122 and a stainless steel grid 124. The spent fuel rod 122 is one such as uranium oxide, typically taken from a nuclear power reactor after serving its useful life in the reactor. Fuel rods from a number of different reactors, i.e., pressurized water reactors, boiling water reactors, breeder reactors, etc., can be utilized. The fuel rod 122 is about 12 millimeters in diameter and primarily emits beta particles. Another radioisotope that emits alpha particles could be cladded to the fuel rod 122 to increase the number of alpha particles being emitted. The stainless steel grid 124 is approximately 1–3 millimeters thick. The grid 124 is generally a fine wire mesh screen. The mesh size can vary but is on the order of 100 mesh. The mesh size of the grid 124 will be such that the alpha particles will be captured in the grid 124 while the beta particles will pass through the grid 124. The grid 124 completely surrounds the fuel rod and is spaced from an outer diameter of the fuel rod approximately 2–3 millimeters. The grid 124 defines a first medium 125 to be described in greater detail below.

As further shown in FIG. 5, the radioactive material assembly 102 has first and second insulative posts 126,128 connected to each end of the assembly 102 for mounting the assembly 102 in the container 104. The first insulative post 126 is connected to the cap 112 of the container 104, and the second insulative post 128 is connected to the bottom of the base 110 of the container 104. The cooperating lips 114,116 between the cap 112 and base 114 of the container 104 form a seam which is sealed to provide the sealed container 104. A space is maintained between an outer diameter of the grid 124 and the plate conductor 105 on the inner surface of the container 104. This space is filled with a liquid, gas or vacuum to provide a desired density. The density is important as it imparts friction against the moving alpha and beta particles and thus effects the movement of the particles. The higher the density, the greater the friction, which in turn slows the particles more rapidly. This will determine the terminal point of travel for the alpha particle and to a lesser degree, the beta particle. The lower the density the further the spacing can be between the grid relative to the fuel rod. In a preferred embodiment, the container is filled with water 136 although other mediums could also be used.

The electrical conductors 106 include a first lead 130 and a second lead 132. The first lead 130 has a first end 130*a* connected to the grid 124, or first medium 125. The first lead 130 extends through the conductor opening 120 to a second end 130*b*. The first lead 130 is insulated from the cap 112 of the container 104 by insulative bushing 134 to prevent a short between the cap 112 and the first lead 130. The second lead 132 has a first end 132*a* connected to the plate conductor 105, or second medium 115, on the inside surface of the container 104. The second lead 132 passes through the container 104 and has a second end 132*b*.

In operation, this second embodiment of the invention operates similar to the first embodiment in that an electrical potential is generated between the grid 124 and plate conductor 105, i.e., between the first medium 125 and the second medium 115. In generating the electrical potential, the fuel rod 122, undergoing radioactive decay, emits both alpha particles and beta particles. It is noted that because a fuel rod is used in this embodiment, the alpha and beta particles emitted generally possess much greater kinetic energy than the alpha and beta particles of the first embodiment. The alpha particles have a large cross-sectional area and travel at a relatively slow velocity. Consequently, the alpha particles only travel a short distance before being slowed and are thus captured in the stainless steel grid 124, or first medium 125. As the alpha particles are positively charged, the first medium 125 becomes positively charged. The beta particles have a very small cross-sectional area and travel at a high rate of speed (approximately three-quarters of the speed of light). The beta particles are slowed less rapidly by the water 136 and can pass through the openings in the grid, therefore, travelling a greater distance than the alpha particles. Consequently, the beta particles are captured by the plate conductor 105, or second medium 115. Thus, it is important to control the density with the water 136 to minimize the possibility that the beta particles will travel completely through the plate conductor 105 and container 104. The beta particles are captured in the material which makes up the plate conductor 105 on the inside surface of the container 104. As the beta particles are negatively charged, the second medium 115 becomes negatively charged. Although the spent fuel rod 122 is emitting both alpha and beta particles, the particles are simply separated due to their physically dissimilar characteristics. Furthermore, the spacing between the fuel rod 122, grid 124 and plate conductor 105, as well as the density provided by the water 136, are set to maximize the number of alpha particles being captured in the first medium 125 and the number of beta particles being captured in the second medium 115. With the first medium 125 being positively charged and the second medium 115 being negatively charged, an electrical potential (EMF) is generated between the first medium 125 and the second medium 115. The electrical potential is present between the second ends 130*b*,132*b* of the first and second leads 130, 132.

As further shown in FIG. 5, an electrical load L is then connected between the first and second leads 130,132. This connection permits current flow to drive the load L. The beta particles captured in the second medium 115 travel from the second medium 115, through the second lead 132, the load L and the first lead 130 and finally to the first medium 125. When the beta particles are first emitted from the spent fuel rod 122, their velocity is too great to be able to combine with the alpha particles. When the beta particles are transmitted to the first medium 125 through the leads 130,132, their velocity is such that the chemical reaction can take place where the alpha particles will then combine with the beta particles to produce helium. In addition, as the beta particles are transmitted to the grid 124, an electromagnetic field will be emitted by the grid 124. The field will assist in drawing the alpha particles into the grid 124.

As the water 136 is also present in the container 104, it is possible that an alpha particle may combine with a pair of electrons from the water molecules. For example, if an alpha particle is emitted at a somewhat lower energy and does not travel completely into the grid 124, the alpha particle will likely capture a pair of electrons from the water. This may result in some ionized water molecules. These ionized water molecules, however, will stabilize by combining with a pair of beta particles transmitted from the second medium 115 through the leads 130,132.

As previously described in the first embodiment, the current provided by the beta particles in the second lead 132 is direct current (DC). A conventional AC converter circuit 140 may be provided to convert the direct current to alternating current (AC).

Figure 6:
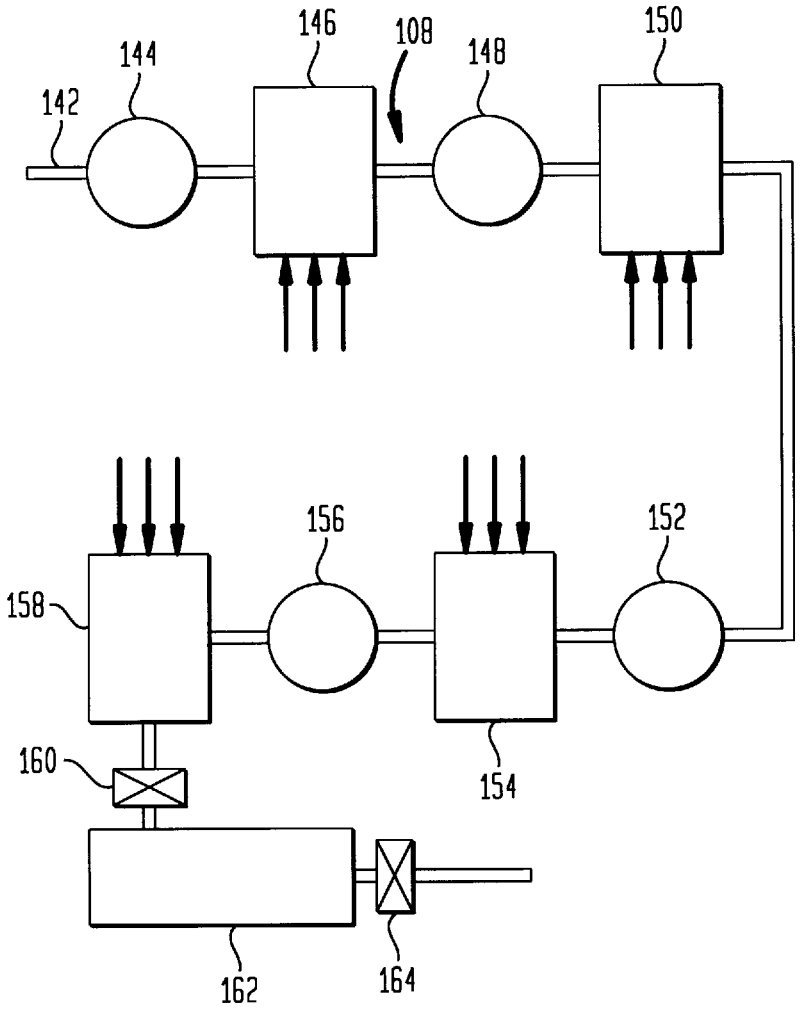
FIG. 6 is a schematic view of a gas removal system used in the battery of FIG. 4; and, FIG. 7 is a schematic view of a third embodiment of a battery of the present invention.

As the load L continues to be driven, additional reactions occur producing more helium. As the battery 100 is typically a large battery, it is beneficial to use the gas removal system 108 to conserve the helium for later use. The gas removal system 108 collects the helium off of the top of the container 104 and liquifies the helium for storage. FIG. 6 shows the gas removal system 108. The system generally includes four pump/heat exchanger pairs, arranged in series, a liquid helium tank and associated valves. It will be understood that other systems could also be used to process the helium for later use.

Specifically, the helium gas exits the container 104 through the gas removal conduit 118 (FIG. 5). The gas continues to a gas line 142 (FIG. 6) directing the helium gas to a first pump 144. The first pump 144 pressurizes the helium gas to a first pressure. The temperature of the helium gas increases due to the increased density of the gas. The pressurized helium gas then passes through a first heat exchanger 146 where the gas is cooled by airflow (designated by the arrows) through the heat exchanger 146. The helium gas then passes through the remaining three pump/heat exchanger pairs 148/150, 152/154, 156/158 where the gas is further pressurized and cooled. If desired, the heat exchangers can be driven by refrigeration equipment to the make the cooling stages more efficient. After the final stage of compression through the fourth pump 156, the helium gas passes through the fourth heat exchanger 158 where the helium gas is condensed to liquid helium. The liquid helium passes through a valve 160 and into a liquid helium storage tank 162. The liquid helium can then be delivered through valve 164 for later use.

Third Embodiment

Figure 7:
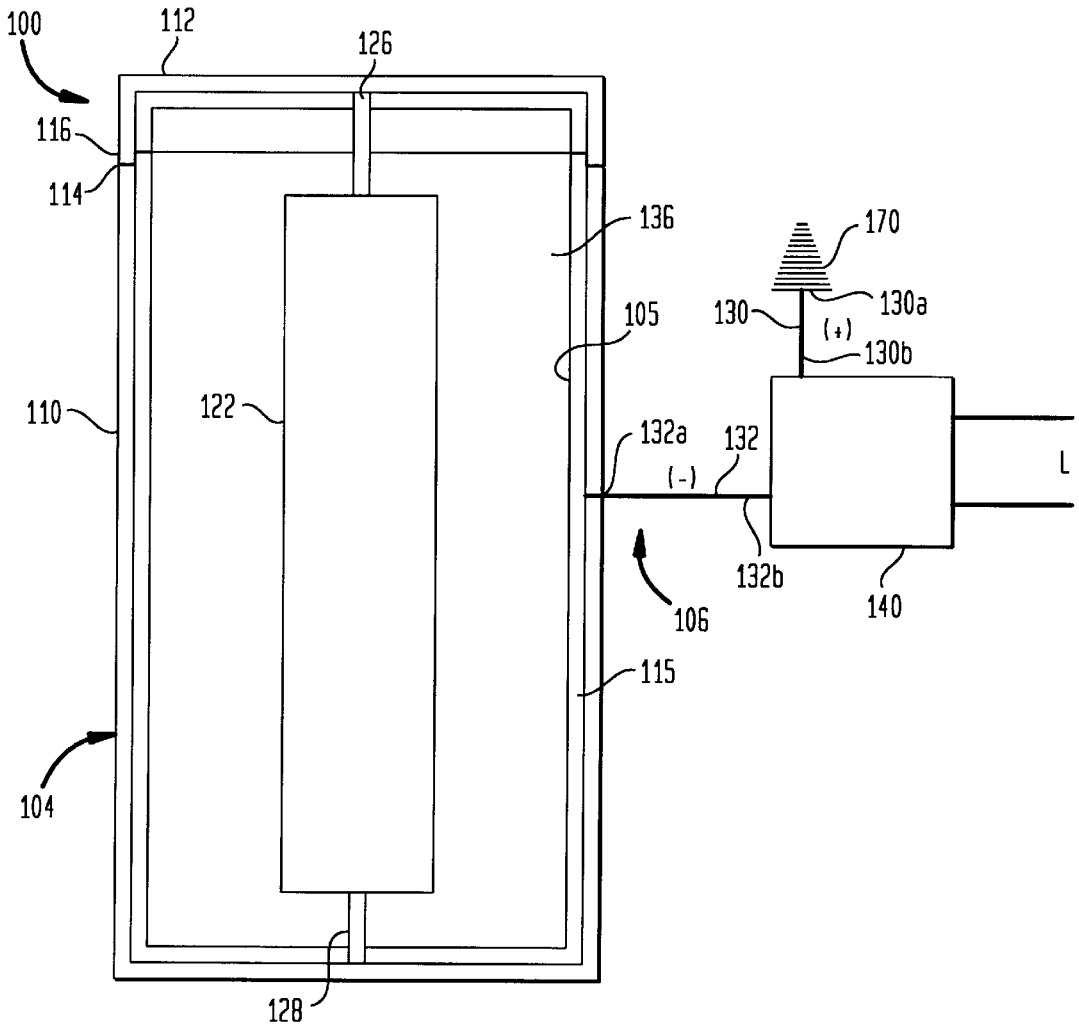

FIG. 7 shows a third embodiment of a nuclear battery of the present invention. The same reference numerals are used as in FIG. 5 as only a slight modification is made in the third embodiment. The third embodiment allows the use of a fuel rod 122 which has not been cladded with a radioisotope that emits alpha particles. As shown in FIG. 7, the first end 130*a* of the first lead 130 is not connected to a grid such as grid 124. Instead, the first end 130*a* is connected directly to an earth ground 170. In such configuration, the electrical potential will still be present, but will be between the second medium 115 and the earth ground 170. Specifically, the second medium 115 is negatively charged by the beta particles due to the high number of nuclear events occurring in the battery 100. The earth ground will be less negatively charged than the second medium 115 and thus will act as a positive. The potential gradient is, therefore, created from the battery to the earth ground. The kinetic energy of the beta particles also adds to the potential for doing work. Instead of the beta particles travelling back into the grid 124, the beta particles travel through the second lead 132, the load L and into the earth ground 170. The earth ground 170 will absorb the beta particles, that is, cations in the earth's soil will absorb the beta particles. In such configuration, the gas removal system 108 is not utilized.

Power Output Capabilities

The power output capabilities of the batteries of the present invention will vary depending on, for example, the particular radioisotope material selected, the amount of material used and the overall resistance in the system. The following calculation is an estimate of the power produced from the decay of the radioactive material and the capture of beta particles by alpha particles to produce helium:

1 Curie equals $3.70\times10^{10}$ disintegrations per second

ALPHA EMITTER:

3.7(DISINTEGRATIONS)×2(VALENCE OF NUCLEI)= 7.4 eV/second/$He^{+2}$ 7.4 eV/second/$He^{+2}$×66 Kcal=488.4 Kcal/second/$He^{+2}$ or 7.4 eV/second/$He^{+2}$×66=488.4 Kj/second/$He^{+2}$ FOR Kcal 488.4 Kcal×2 (Conversion for $He_2$)=976.8 Kcal/second/$He_2$ 976.8 Kcal/second/$He_2$×$3.9685\times10^{-3}$ (Conversion to BTU's)=3.8764 BTU's/second/$He_2$ 3.8764 BTU's/second/He molecule×$2.928\times10^{-4}$ (Conversion to KWh)=$0.001135\times10^{10}$ KWh 11,350,000.00 KWh/curie The plates 16,18 in FIG. 1 are a primary means for capturing the alpha and beta particles. The stainless steel grid is another structure which can be used to capture the particles. It will be understood that other structures and methods can be used to capture the particles and thus create an electrical potential between positively and negatively charged mediums.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

I claim:

1. A battery comprising:

a first radioisotope emitting alpha particles;

a second radioisotope emitting beta particles;

a first plate positioned proximate the first radioisotope adapted for capturing the alpha particles and being positively charged;

a second plate positioned proximate the second radioisotope, insulated from the first plate, adapted for capturing the beta particles and being negatively charged resulting in an electrical potential being formed between the first plate and the second plate;

a housing accommodating the radioisotopes and plates;

a first lead connected to the first plate and a second lead connected to the second plate, an electrical potential being generated between the two leads;

openings in the housing to receive the two leads; and an electrical load connected between the first and second leads for permitting the beta particles to travel from the second plate, through the second lead, the load and the first lead and to the first plate, the alpha particles in the first plate capturing beta particles transmitted thereto to produce helium.

2. The battery of claim 1 further including: a converter disposed between the first and second leads for converting the direct current (DC) provided by the beta particles to alternating current (AC).

3. A battery comprising:

a first radioisotope emitting alpha particles;

a second radioisotope emitting beta particles;

a first plate positioned proximate the first radioisotope adapted for capturing the alpha particles wherein the first plate is positively charged;

a second plate positioned proximate the second radioisotope, insulated from the first plate, adapted for capturing the beta particles and being negatively charged for establishing an electrical potential between the first plate and the second plate; and, a housing accommodating the radioisotopes and plates, and having a first contact connected to the first plate and a second contact connected to the second plate, an electrical potential being generated between the two contacts;

an electrical load connected between the first and second contacts for permitting the beta particles to travel from the second plate, through the second contact, the load and the first contact and to the first plate, the alpha particles in the first plate capturing beta particles transmitted thereto to produce helium.

4. A battery comprising:

radioactive material emitting alpha particles and beta particles therefrom;

a grid defining a first medium positioned proximate the radioactive material, the alpha particles being captured in the first medium and positively charging the first medium;

a container encasing the radioactive material and the grid, the container being insulated from the radioactive material and the grid and defining a second medium, the beta particles passing through the grid and being captured in the second medium and negatively charging the second medium, an electrical potential being generated between the first and second mediums;

a first lead and a second lead each having a first and second end, the first end of the first lead being connected to the first medium and the first end of the second lead being connected to the second medium, the electrical potential being between the second ends of the two leads; and an electrical load connected between the first and second leads for permitting the beta particles captured by the container to travel from the second medium, through the second lead, the load and the first lead to the first medium, the alpha particles in the first medium capturing beta particles transmitted thereto to produce helium.

5. The battery of claim 4 further including a conduit passing through the container for transporting the helium produced to a cryogenic system adapted for liquefying the helium.

6. The battery of claim 4 wherein the container is filled with water providing a sufficient density to maximize the alpha particles being captured in the grid and to maximize the beta particles being captured in the container, the alpha particles capturing a pair of electrons from the water, the electrons being replaced with a pair of beta particles from the second medium.

7. A battery comprising:

radioactive material emitting alpha particles and beta particles therefrom;

a grid defining a first medium positioned proximate the radioactive material, the alpha particles being captured in the first medium and positively charging the first medium; and, a container encasing the radioactive material and the grid, and being insulated from the radioactive material and the grid, the container having an inside surface plated with a conductor defining a second medium, the beta particles passing through the grid and being captured in the second medium and negatively charging the second medium, the container being filled with water of a sufficient density to ensure the alpha particles are captured in the grid and the beta particles are captured in the container, an electrical potential being generated between the first and second mediums;

a first lead and a second lead each having a first and second end, the first end of the first lead being connected to the first medium and the first lead of the second lead being connected to the second medium, the electrical potential being between the second ends of the two leads;

an electrical load connected between the first and second leads for permitting the beta particles captured by the container to travel from the second medium, through the second lead, the load and the first lead and to the first medium, the alpha particles in the first medium capturing electrons from the water and from the second medium to produce helium, the electrons captured from the water being replaced by the beta particles from the second medium; and a conduit passing through the container for transporting the helium produced to a cryogenic system adapted for liquefying the helium.

8. An apparatus for converting radioactive energy into electrical energy, the radioactive energy in the form of alpha particles and beta particles being emitted from radioactive material, comprising;

means for capturing the alpha particles in a first medium and positively charging the first medium;

means for capturing the beta particles in a second medium and negatively charging the second medium, an electrical potential being generated between the first and second mediums; and means for electrically connecting a load between the first and second mediums to permit the beta particles captured by the second medium to travel from the second medium, through the load and to the first medium, the alpha particles in the first medium capturing beta particles transmitted thereto to produce helium.

9. A method of converting radioactive energy to electrical energy, the radioactive energy being in the form of alpha particles and beta particles emitted from radioactive material, comprising the steps of:

capturing the alpha particles emitted from the radioactive material in a first medium, the first medium becoming positively charged;

capturing beta particles emitted from the radioactive material in a second medium, the second medium becoming negatively charged;

establishing an electrical potential between the first and second mediums; and placing an electrical load between the first and the second mediums to permit the beta particles to travel from the second medium to the first medium and the alpha particles to capture beta particles for the production of helium.

10. The method of claim 9 further including the step of liquefying the helium.

11. A method of converting radioactive energy to electrical energy comprising the steps of:

emitting alpha particles from a first radioisotope;

emitting beta particles from a second radioisotope;

capturing the alpha particles in a first plate, the first plate becoming positively charged;

capturing the beta particles in a second plate, the second plate becoming negatively charged;

establishing an electrical potential between the first and second plates;

connecting a first lead to the first plate and connecting a second lead to the second plate;

establishing an electrical potential between the two leads; and connecting an electrical load between the first and second leads and permitting the beta particles to travel from the second plate, through the second lead, the load and the first lead and to the first plate, the alpha particles in the first plate capturing beta particles transmitted thereto to produce helium.

12. The method of claim 11 further including the step of converting direct current (DC) provided by the beta particles to alternating current (AC).

* * * * *